US006382963B2

(12) United States Patent
Ramesohl

(10) Patent No.: US 6,382,963 B2
(45) Date of Patent: May 7, 2002

(54) GRATE COOLER

(75) Inventor: Hubert Ramesohl, Bergisch-Gladbach (DE)

(73) Assignee: KHD Humboldt Wedag AG, Cologne (DE)

( * ) Notice: Subject to any disclaimer, the term of this patent is extended or adjusted under 35 U.S.C. 154(b) by 0 days.

(21) Appl. No.: 09/817,496

(22) Filed: Mar. 26, 2001

(30) Foreign Application Priority Data

Mar. 25, 2000 (DE) ..... 100 15 054

(51) Int. Cl.[7] ..... F27D 15/02
(52) U.S. Cl. ..... 432/77; 432/78; 110/290
(58) Field of Search ..... 432/77, 78; 110/113, 110/266, 290, 298, 299, 300

(56) References Cited

U.S. PATENT DOCUMENTS 4,732,561 A * 3/1988 Eiring et al. ..... 432/78

FOREIGN PATENT DOCUMENTS

| | | |
|---|---|---|
| EP | 0634619 | 1/1995 |
| EP | 0718578 | 6/1996 |

* cited by examiner

*Primary Examiner*—Gregory Wilson
(74) *Attorney, Agent, or Firm*—Charles L. Schawb; Nexsen Pruet Jacobs & Pollard, LLC

(57) ABSTRACT

A grate cooler of simple construction whose cooling grate is substantly protected against wear and which can be operated in simple fashion and with a high cooling efficiency. A plurality of rotatably supported tubular oscillating shafts, spaced apart from one another, are arranged transversely to the conveyance direction of cooling feed material above a stationary cooling grate. Upwardly extending shovel arms (16*a*, 16*b*, 16*c*), are attached to the shafts which move with a reciprocating oscillatory motion (17) in the conveyance direction of cooling feed material. The shovel arms have a pushing surface on their forward side and a wedge surface on their rearward side and, in their oscillatory motion, moving the hot bed of cooling feed material successively from the beginning of grate-cooler to the discharge of the grate cooler.

11 Claims, 2 Drawing Sheets

10
11
12
13
13
14
15a
15b
15c
16a
16b
16c
17
α
β

GRATE COOLER

TECHNICAL FIELD

This invention relates to a grate cooler with a cooling grate through which cooling gas flows and over which the cooling feed material, such as hot cement clinker, can move.

BACKGROUND OF THE INVENTION

Grate coolers are used in the nonmetallic mineral industry for the rapid cooling of material previously burned in a furnace, such as for example cement clinker or other mineral materials, by cooling such material immediately thereafter on the cooling grate of the grate cooler. Along with traveling-grate coolers, devices widely used to convey hot feed material through the cooling region of the cooler include reciprocating-grate coolers, in which the grate system includes a multiplicity of alternately fixed and moving grate-plate carriers, to each of which are attached a plurality of grate plates provided with cooling air holes and through which cooling air flows substantially upwardly from below. As viewed in the conveyance direction of such coolers, fixed rows of grate plates alternate with rows of reciprocatingly movable grate plates, which are collectively attached, via their correspondingly reciprocatingly movably supported grate-plate carriers, to one or a plurality of longitudinally movably supported driven thrust frames. By virtue of the collectively oscillatory motion of all movable rows of grate plates, the material to be cooled, for example the hot cement clinker, is conveyed in pushing fashion while being cooled. In order to protect the grate plates from thermal-mechanical overloading, it is known to provide the plate tops with troughs or pockets for the accommodation and retention of cooling feed material, which then forms a protective bed for the hot feed material being cooled, which slides thereover. Such pockets are shown in European patent EP 0634 619 B2 issued to G. Dittman et. al. on Mar. 10, 1999 for a Grate Plate for a Grate Plate Cooler.

European patent EP 0718 578 A2 of T. Enhegaard published Jun. 26, 1996 for Method and Cooler for Cooling Particulate Material discloses a grate cooler in which the cooling grate, through which cooling air flows, does not move, but in which a row of reciprocatingly movable beam-shaped conveying elements is arranged transversely to the material conveyance direction above the grate surface. The material in the bed of material to be cooled is said to be moved successively from the beginning of the cooler to the end of the cooler by the reciprocating motion of the beam-shaped conveying elements. The wear problem occurring particularly in the reciprocating-grate cooler, especially in the overlap region of adjacent moving and fixed rows of grate plates, and resulting from cement clinker abrasion and sticking of material in the overlap region of the grate plates, is claimed to be reduced in this type of grate cooler.

OBJECTS AND SUMMARY OF THE INVENTION

It is an object of the invention to create an improved grate-cooler which is relatively simple in construction, has a cooling grate largely protected against wear, and can be operated in simple manner with a high cooling efficiency.

In the grate cooler of this invention, the cooling grate is stationary, that is, it does not include any moving parts. A plurality of rotatably supported tubular shafts, spaced apart from one another, are arranged transversely to the conveyance direction of cooling feed material above the stationary cooling grate, and attached to the side of the tubular shafts turned away from the stationary cooling grate are upwardly extending shovel arms, which execute a reciprocating oscillatory motion in the conveyance direction of cooling feed material. These shovel arms, acting as one-armed levers, which have a pushing surface on their forward side and a wedge surface on their rearward side, lie with their pushing surface in the hot bed of cooling feed material, and in their forward and backward oscillation they move the hot bed of cooling feed material successively from the cooling-grate beginning to the cooling-grate end. For protection against overheating by the hot clinker bed, a cooling medium such as, for example, cooling air flows through the hollow shafts supporting the shovel arms, this cooling medium being able to flow into the bed of cooling feed material via holes distributed about the circumference of the tubular shaft, and there to effect additional cooling of the cooling feed material.

Because the cooling grate is stationary and includes no moving parts, it is especially advantageous to provide the cooling grate with grate plates or regions with troughs for cooling feed material or pockets for cooling feed material in order to hold and retain cooling feed material so that, in the operation of the grate cooler, a lower, precooled bed of material or guard bed is formed on the stationary cooling grate, over which bed the hot material to be cooled is moved by the oscillating shovel arms. The bearings and the oscillatory drive or oscillatory drives of the shafts occupied by the shovel arms are advantageously arranged outside the lateral walls of the cooler in a manner protected from the hot cooling feed material.

According to a further feature of the invention, the pivot angle between the pushing surface of the oscillating shovel arms and the cooling-grate plane covers a range from about 160° to about 90°, that is, a differential pivot-angle range of about 70°. This means that the pushing surfaces of the oscillating shovel arms can move the hot cooling feed material obliquely upwardly, up to approximately parallel to the cooling-grate plane, in the conveyance direction of cooling feed material, that is, the limitation of the forward oscillatory motion prevents the cooling feed material from being pressed against the cooling grate by the pushing surfaces of the shovel arms. At the same time, the oscillatory motion of the shovel arms causes frittings-together or agglomerations of the hot cooling feed material, such as for example cement clinker, to be broken up again by the shovel arms without the shovel arms being conveyed into the lower, colder bed of cooling feed material. The height of the oscillating shovel arms, that is, the radial extent of the one-armed lever arms, can be different; for example, especially high shovel arms can be used in the initial region of the grate cooler in order to promote the effect of breaking up agglomerations of cooling feed material. Thus an intermediate crusher, for example in the form of crushing rolls, often used previously in a grate cooler of conventional design, can be omitted.

BRIEF DESCRIPTION OF THE DRAWINGS

The invention and its further features and advantages are explained in more detail on the basis of an exemplary embodiment illustrated schematically in the Figures, in which.

DETAILED DESCRIPTION OF THE INVENTION

Figure 1:
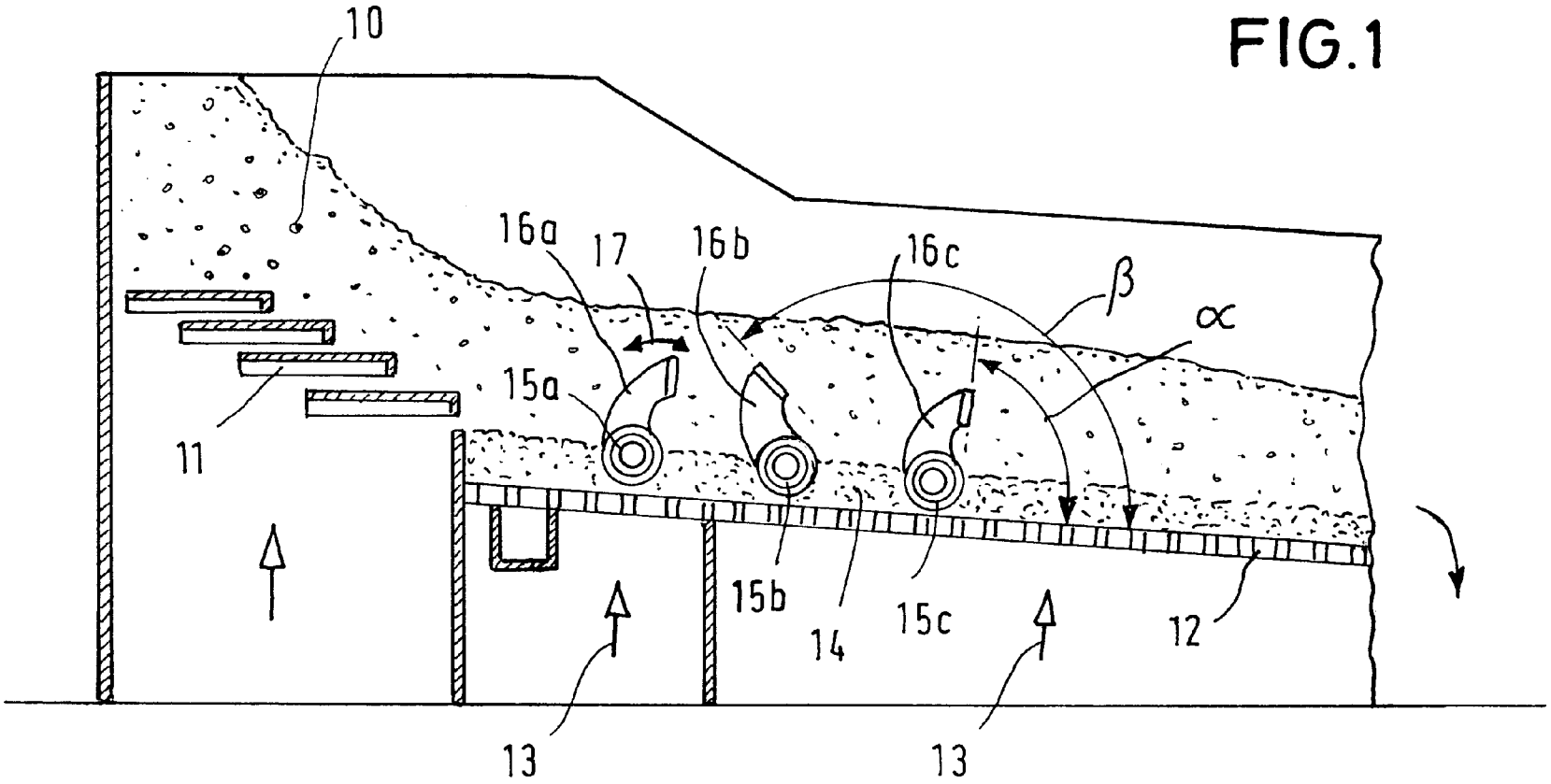
FIG. 1 shows schematically, in excerpt fashion, a vertical longitudinal section through a grate cooler operating to cool hot cement clinker discharged from a rotary kiln, with the shovel arms oscillating in the bed of cooling feed material.

Referring to FIG. 1, hot cement clinker 10 discharged from a rotary kiln is conveyed via a material transfer device 11, such as for example stationary cascade grate, to a cooling grate 12, through which cooling air 13 can flow substantially upwardly from below, and which is arranged in stationary fashion, that is, which includes no moving parts. The cooling grate 12 is usually assembled from individual grate plates, which are designed in such a way that, on the one hand, the material 10 to be cooled is prevented as far as possible from dropping through the cooling grate and, on the other hand, the permeability of the cooling grate for cooling air 13 is maintained. The grate plates of the cooling grate 12 advantageously have troughs for cooling feed material or pockets for cooling feed material on their top in order to hold and retain cooling feed material 10, so that a lower, precooled bed of material or guard bed 14 is formed on the cooling grate 12, over which the bed hot clinker 10 to be cooled is moved, so that wear of the cooling grate or of its grate plates is minimized.

A plurality of rotatably supported tubular shafts 15*a*, 15*b*, 15*c* extend through the guard bed 14 above the cooling grate 12 and transverse to the conveyance direction of the cooling feed material. Upwardly extending shovel arms 16*a*, 16*b*, 16*c* are attached to the side of the shafts 15*a*, 15*b*, 15*c* opposite the cooling grate 12 which execute a reciprocating oscillatory motion 17 when the shafts 15*a*, 15*b*, 15*c* are pivoted thereby moving the cooling feed material to the right as viewed in FIG. 1.

Figure 2:
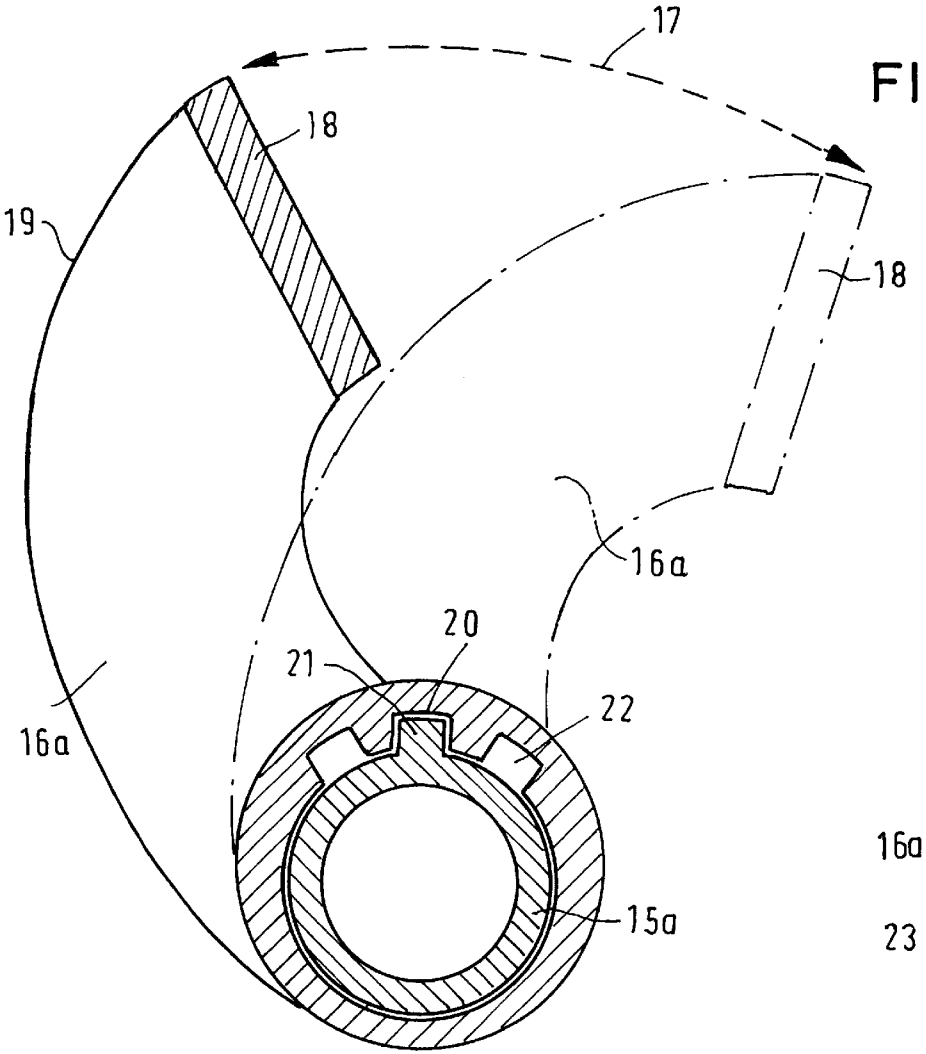
FIG. 2 is an enlarged scale the lateral view of a shovel arm showing two oscillatory positions.

As shown in greater detail in FIG. 2, the shovel arms 16*a*, 16*b*, 16*c* have on their forward side, or free ends, a shovel in the form of a wear plate 18 presenting a pushing surface. The wear plate 18 is attached by bolting, welding or other joining method. As can be seen particularly in FIG. 3, the shovel arms have a wedge surface 19 on their rear side, which slide in arrow fashion or in streamline fashion through the bed of cooling feed material as shovel arms 16*a*, 16*b*, 16*c* oscillate rearward, so that the expenditure of force and the wear are minimized. When the shovel arms are oscillated, they act as one-armed levers conveying hot cooling feed material 10 successively from the beginning to the end of cooling grate 12 over the already cooled lower bed of material 14.

The forward oscillatory motion of the shovel arms is limited in such a way that the shovel arms 16*a*, 16*b*, 16*c* do not press the cooling feed material onto the cooling grate 12, that is, the angle $\alpha$ between pushing surface of the wear plate 18 of the shovel arms and the cooling-grate plane is at least 90°. The pivot angle $\beta$ between the pushing surface of the wear plate 18 of the oscillating shovel arms and the plane of cooling grate 12 can range between about 160° and 90°, that is, in terms of the difference, a pivot-angle range 17 of about 70°. In other words, the shafts 15*a*, 15*b*, 15*c* are rotated 70 degrees during operation to move the pushing surface through a 70 degree arc in the direction of movement of the material being cooled. In this way, the shovel arms with their shovels 18 move the hot cooling feed material obliquely upwardly to, maximally, a direction parallel to the cooling-grate plane which is the conveyance direction of cooling feed material, and then swing back to again break up agglomerations of hot cooling feed material. The hot cooling feed material 10 is not pressed into already cooled lower bed of material 14 by the operation of the oscillating shovel arms.

Figure 3:
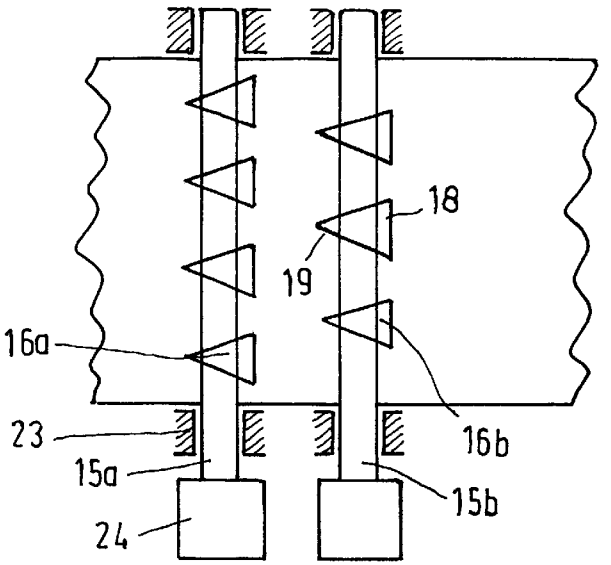
FIG. 3 is a schematic top view of the grate cooler of FIG. 1.

As can be seen in FIG. 3, a plurality of shovel arms 16 are attached to the shafts 15*a*, 15*b*, in axially spaced relation and in an interchangeable manner, by a key-and-keyway connection illustrated in FIG. 2. The shovel arm 16*a* may be made from a casting and have a keyway 20 in its hub in which a key 21 of the hollow shaft 15*a* is engaged. As shown in FIG. 2, further keyways 22 can be present in the hub of shovel arm 16*a*, and by various occupation of keyways 20, 22, etc., neighboring shovel arms 16 on one shaft can also differ in radial orientation or positioning, thereby producing regionally varying conveying speeds in hot cooling feed material bed 10 being conveyed as all the shovel arms oscillate collectively. In this way, for example, it is possible in particular to avoid formation of the so-called red river, in which still red-hot lumps of clinker can roll down the slope formed by heaped-up hot cooling feed material.

Shovel arms 16 can be used until wear plates 18 are completely worn by shifting to other locations in the grate cooler according to the invention.

It can further be seen in FIG. 3 that the shovel arms 16*a*, 16*b* of neighboring shafts 15*a*, 15*b* can be arranged offset to one another, that is, staggered, so that the entire width of the bed of cooling feed material 10 can be covered by the oscillating shovel arms for the purpose of conveying the material and also for the purpose of breaking up agglomerated lumps of clinker.

Bearings 23 and oscillatory drives 24 for the shafts 15*a*, 15*b*, 15*c* are positioned in a protected fashion outside the lateral walls of the cooler. For protection against thermal overload, a cooling medium, such as cooling air, can flow through the tubular shafts 15*a*, 15*b*, 15*c*, which cooling medium can issue through perforations, not shown, in the hollow shafts into the bed of cooling feed material for the purpose of additionally cooling it. Each of the shafts 15*a*, 15*b*, 15*c* are driven by its own oscillating drive 24, but a single drive for a plurality of tubular shafts may be used. Oscillatory travel 17 between the two end positions of shovel arms 16*a*, 16*b*, 16*c* are individually adjustable in the oscillating drive 24.

The grate cooler of this invention has a high cooling efficiency, and its cooling grate is substantially protected against wear. Also this cooling grate is relatively simple in construction which results in economical manufacturing cost. The invention is applicable not only to grate-cooler types with chamber aeration of the grate plates, in which the bottom part of the cooler beneath the cooling grate is divided into a plurality of chambers separated from one another, but also to types of grate-coolers having row aeration of the grate plates, in which the cooling air is guided through hollow grate-plate support beams, from which the cooling air flows into special grate plates attached thereto and likewise provided with cooling-air ducts.

What is claimed is:

1. A grate cooler comprising:

a stationary cooling grate (12) through which cooling gas flows and over which the cooling feed material to be cooled, such as hot cement clinker, can move in a predetermined conveyance direction;

a plurality of horizontally extended and rotatably supported tubular shafts (15*a*, 15*b*, 15*c*) above said stationary cooling grate (12) spaced in parallel relation to one another in said conveyance direction and disposed axially transverse to said conveyance direction;

upwardly extending shovel arms (16*a*, 16*b*, 16*c*) attached at one end to of said tubular shafts (15*a*, 15*b*, 15*c*) and presenting a free end, said shovel arms (16*a*, 16*b*, 16*c*) executing a fore and aft reciprocating oscillatory motion (17) in said conveyance direction of said cooling feed material when said tubular shafts are oscillated; and each of said shovel arms (16*a*, 16*b*, 16*c*) having a pushing surface (18) on the forward side of said free end and a wedge surface (19) on their rearward side.

2. The grate cooler as set forth in claim 1 wherein forward oscillatory motion of said shovel arms is limited so that said shovel arms do not press said cooling feed material onto said cooling grate.

3. The grate cooler as set forth in claim 2 wherein the angle between said pushing surface and a plane defined by said cooling grate in said conveyance direction is at least 90°.

4. The grate cooler set forth in claim 2 wherein during operation of said grate cooler the said oscillating shovel arms (16*a*, 16*b*, 16*c*) move in a 70° degree arc.

5. The grate cooler of claim 1 wherein said shovel arms (16*a*, 16*b*, 16*c*) are interchangeably attached to said shafts (15*a*, 15*b*, 15*c*).

6. The grate cooler of claim 5 wherein said shovel arms (16*a*, 16*b*, 16*c*) are connected to said shafts (15*a*, 15*b*, 15*c*) by key-and-keyway connections (20, 21) including a plurality of keyways (20, 22) formed in said shovel arms (16*a*, 16*b*, 16*c*) permitting changes in radial orientation of said shovel arms (16*a*, 16*b*, 16*c*).

7. The grate cooler as set forth in claim 1 wherein said shovel arms (16*a*, 16*b*, 16*c*) on one of said shafts (15*a*, 15*b*, 15*c*) are staggered in relation to said shovel arms (16*a*, 16*b*, 16*c*) on another one of said shafts (15*a*, 15*b*, 15*c*).

8. The grate cooler as set forth in claim 1 wherein said stationary cooling grate (12) includes cooling-grate segments with troughs or pockets for retaining cooling feed material whereby a lower, precooled bed of said retained material (14) is maintained on the cooling grate and wherein said oscillating shovel arms (16*a*, 16*b*, 16*c*) move the material to be cooled (10) over said retained material (14) in the conveyance direction of said cooling grate (12).

9. The grate cooler of claim 1 wherein said shovel arms (16*a*, 16*b*, 16*c*) each include a wear plate (18) on which said pushing surface is formed.

10. The grate cooler as set forth in claim 1 having bearings (23) and an oscillatory drive (24) for said shafts (15*a*, 15*b*, 15*c*), said bearings (23) and said oscillating drive (24) being positioned outside of the lateral walls of said grate cooler.

11. The grate cooler as set forth in claim 1 wherein said shafts (15*a*, 15*b*, 15*c*) are hollow and serve to convey cooling air to said grate cooler.

* * * * *